United States Patent [19]

Werner

[11] 4,318,526

[45] Mar. 9, 1982

[54] ADJUSTABLE TELESCOPIC DEVICE

[76] Inventor: Per G. Werner, N-1460 Spro, Norway

[21] Appl. No.: 72,635

[22] Filed: Sep. 6, 1979

[30] Foreign Application Priority Data

Sep. 13, 1978 [NO] Norway ..... 783089

[51] Int. Cl.[3] ..... F16M 11/26

[52] U.S. Cl. ..... 248/412

[58] Field of Search ..... 248/123.1, 162.1, 335, 248/337, 412

[56] References Cited

U.S. PATENT DOCUMENTS

| | | | |
|---|---|---|---|
| 478,840 | 7/1892 | Briggs et al. | 248/412 |
| 3,467,352 | 9/1969 | Bohler | 248/412 |
| 3,865,341 | 2/1975 | Fortnam | 248/412 |
| 4,033,543 | 7/1977 | Ponzellini | 248/412 |

FOREIGN PATENT DOCUMENTS

| | | | |
|---|---|---|---|
| 1804404 | 5/1970 | Fed. Rep. of Germany | 248/412 |
| 2048284 | 4/1972 | Fed. Rep. of Germany | 248/412 |
| 1429584 | 8/1973 | Fed. Rep. of Germany | 248/412 |
| 1093531 | 11/1954 | France | 248/412 |
| 2,031,057 | 4/1980 | United Kingdom | 248/412 |

*Primary Examiner*—William H. Schultz
*Attorney, Agent, or Firm*—Holman & Stern

[57] ABSTRACT

In a vertical telescopic device having an inner tube which carries a load such as from the seat of a chair and is adjustably mounted in an outer tube and adapted to be locked to the same by rolling elements releasably spring loaded from below and wedged between the outer tube and downwardly tapering faces of the inner tube, the rolling elements are shaped as rollers with a surface generatrix matching the inner face of the outer tube. Even the said tapering faces have a corresponding cross-sectional shape. In a structure where the spring member loading the rollers also serves for elongating the device in released condition, additional locking rollers are wedged between the outer tube and upwardly tapering faces likewise subjected to the spring load.

5 Claims, 6 Drawing Figures

ADJUSTABLE TELESCOPIC DEVICE

BACKGROUND OF THE INVENTION

1. Field of the Invention

The invention relates to adjustable telescopic devices of the kind designed for substantially vertical mounting and having an inner tube which is slidably inserted in an outer tube and projects upwards from the same and which is adapted to carry a load and near its lower end can be locked to the outer tube. The invention has been developed with a view to being used in spindles for adjustable working chairs, that is where the load is constituted by the weight of the user with the addition of that of the seat and possible the back of the chair, but may also be contemplated to be used in several other situations such as for adjustable table legs, scaffold legs, stays for agricultural implements etc. where a height adjustment is required.

The possibility of adjusting the height of working chairs is very import in many situations, especially where the same working place is used by different persons at different times, since a correct sitting level is important for the physiology and comfort of the user. But in order that this possibility is really constantly utilized when the demand arises, it is necessary that the adjusting system can be operated quickly and from seated position even by persons without special technical insight.

2. Description of the Prior Art

For this purpose telescopic devices of the kind referred to are frequently used, and a problem in that connection is to combine the possibility of easy operation with safe locking in adjusted positions. In many telescopic devices the locking takes place by some form by wedging action by using axially movable spring loaded wedges which either press tongues of the inner tube outwards towards the outer tube or are wedged between inner and outer tube. However, here a difficulty resides in that, although a small wedge angle ensures safe locking, it requires a great force for the release, whereas with greater wedging angles the locking becomes less safe. The use of wedge pieces between the outer tube and downwardly tapering faces on the inner tube has been mentioned already in the German Patent Specification No. 130 366 from 1901, but that specification also describes and shows a different possibility, i.e. to replace the wedge pieces by balls actuated from below by a spring loaded disc. With this device locking will take place by wedging of the balls under the spring load and be the more firm the greater the weight resting on the seat, whereas for adjusting movements in retracted position of the disc, only rolling friction has to be overcome.

A drawback in that connection is, however, that under heavy load from the weight of the user the balls will exert a heavy punctual strain on the outer tube by outward forces with the result that the latter can be deformed and gradually become permanently damaged, so that the function becomes unsatisfactory and operation from seated position will no more be possible.

SUMMARY OF THE INVENTION

The present invention affords in this respect a satisfactory solution which is well compatible with all demands of importance that are made on a height adjustment for a chair and is applicable both in simple and inexpensive forms and in advanced designs.

Even here the locking takes place with rolling elements which by means of a spring loaded supporting element are pressed up between the inner face of the outer tube and downwardly tapering faces of the inner tube so as to be wedged therebetween, and which can be released by manual actuation of the supporting element against the spring load. What primarily characterizes the telescopic device according to the invention, is that the rolling elements are constituted by rollers, the circumferential surface of which has a generatrix corresponding to the cross-sectional shape of the inner face of the outer tube. Even the tapering contact faces of the inner tube are preferably made with a cross-sectional shape substantially corresponding to the generatrix of the rollers.

Since the locking in all adjusted positions thereby takes place by linear contact of the engaging faces it becomes possible to obtain both a safe and sure clamping and easy release without the risk that deformations with undesirable influence on the function will occur, even after prolonged use with frequent adjustments.

In advanced embodiments in which the spring means which causes the locking, is also used for elongating the telescopic device, that is for lifting the seat in released condition, an additional safeguard against unintentional displacement may consist in that between the inner face of the outer tube and upwardly tapering faces of a part connected to the supporting element, there are inserted additional rolling elements which in locked position of the device contribute in locking against upward pulling of the inner tube.

In the following description the invention will be explained in connection with embodiments while having reference to the attached drawings, and in that connection even additional features of the invention will become apparent.

DESCRIPTION OF A SIMPLE EMBODIMENT

Figure 1:
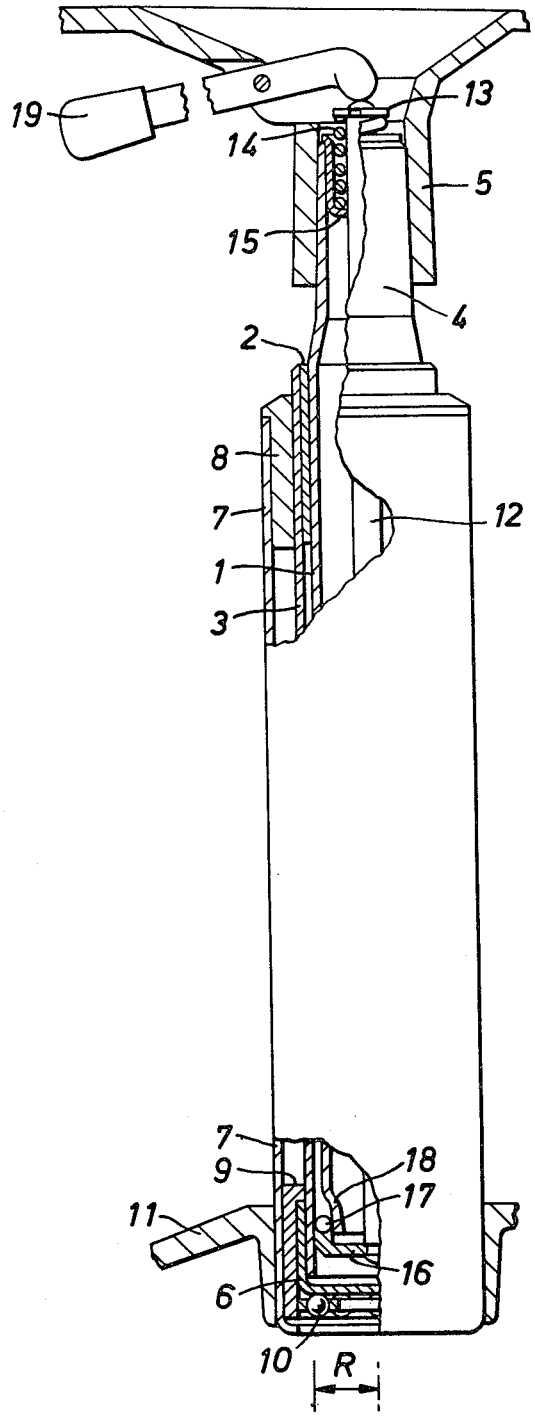
FIG. 1 shows a chair spindle including a simple embodiment of the telescopic device according to the invention in elevation and partly in axial section.

In FIG. 1 the telesocpic device shown includes an inner tube 1, which is slidable vertically in a bearing 2 in the outer tube 3 of the telescopic device and at the top projects upwards from the latter with a conically tapering end portion 4 suited for having mounted thereon a corresponding fitting 5 which for example may carry a chair seat directly or through a pivotal fitting or the like. The outer tube is closed at its lower end by a bottom 6 and is rotatably supported in a surrounding box 7 by radial bearings 8 and 9 and an axial ball bearing 10. The box 7 is in turn mounted with its lower end in the bottom frame of the chair, diagrammatically indicated at 11.

Figure 2:
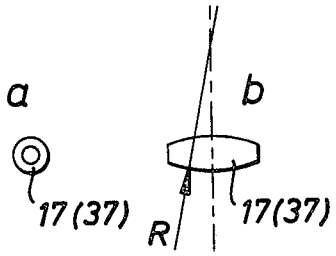
FIGS. 2*a* and *b* are an end view and a side view, respectively, of a roller used in the locking system of the telescopic device.
Figure 3:
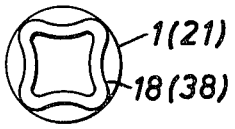
FIG. 3 is a bottom view of the inner tube of the telescopic device.

A rod 12 extending axially through the inner tube 1 is supported at its upper end by means of a washer 13 riveted thereto and engaged by a helical spring 14 surrounding the tube and mounted in a spring box 15 which is inserted in the upper end of the tube 1 and rests with a flange on the end surface of the latter. Riveted to the lower end of the rod 12 is a disc-shaped supporting element 16, which is located below the lower end of the tube 1 and at its edge supports rolling element 17, which are evenly spaced around the circumference of and in contact with the inner face of the outer tube 3 and with downwardly tapering outer faces 18 of the inner tube 1. As shown in FIG. 2 the rolling elements 17 are constituted by barrel-shaped rollers, the circumferential surface of which is defined by a generatrix in the form of a circular arc having the same radius R as the inner face of the outer tube 3, which in the embodiment shown, like the inner tube 1, has circular cross-section as usual. Even the contacting faces 18 of the inner tube 1 have, as shown in FIG. 3, a corresponding transverse curvature with radius R, so that the rollers 17 have linear contact with both tubes. Thus, under the action of the spring 14 the disc 16 presses the rollers 17 up into the space between the tubes so as to lock these together, and to this effect the spring 14 and the inclination of the contacting faces 18 are adapted for affording a safe locking force. It will be understood that the spring force required will be relatively modest relative to the radial pressing force on the rollers 17, consequent to the sloping plane-action of the faces 18.

Release of the locking system for length adjustment takes place with a lever 19 which is accessible for the user in seated position and is pivoted in the fitting 5 at 20, and which at its inner extremity engages the upper end of the rod 12, so that the supporting disc 16 is pressed down by lifting the lever 19. In absence of pressure from the disc 16 it will thereby be possible to raise and lower the inner tube 1, the rollers 17 only affording resistance by rolling friction so long as the lever is kept lifted. During the adjustment, which takes place manually by raising or lowering the seat with the inner tube 1, the user will in this case have to lift himself off the seat, but he will not have to rise. When the adjustment has been terminated he releases the lever 19, so that the rollers 17 again adopt the locking position, and the locking action is enhanced when he then sits down anew, as his weight will have the effect of wedging the rollers 17 more firmly.

DESCRIPTION OF A PREFERRED EMBODIMENT

Figure 4:
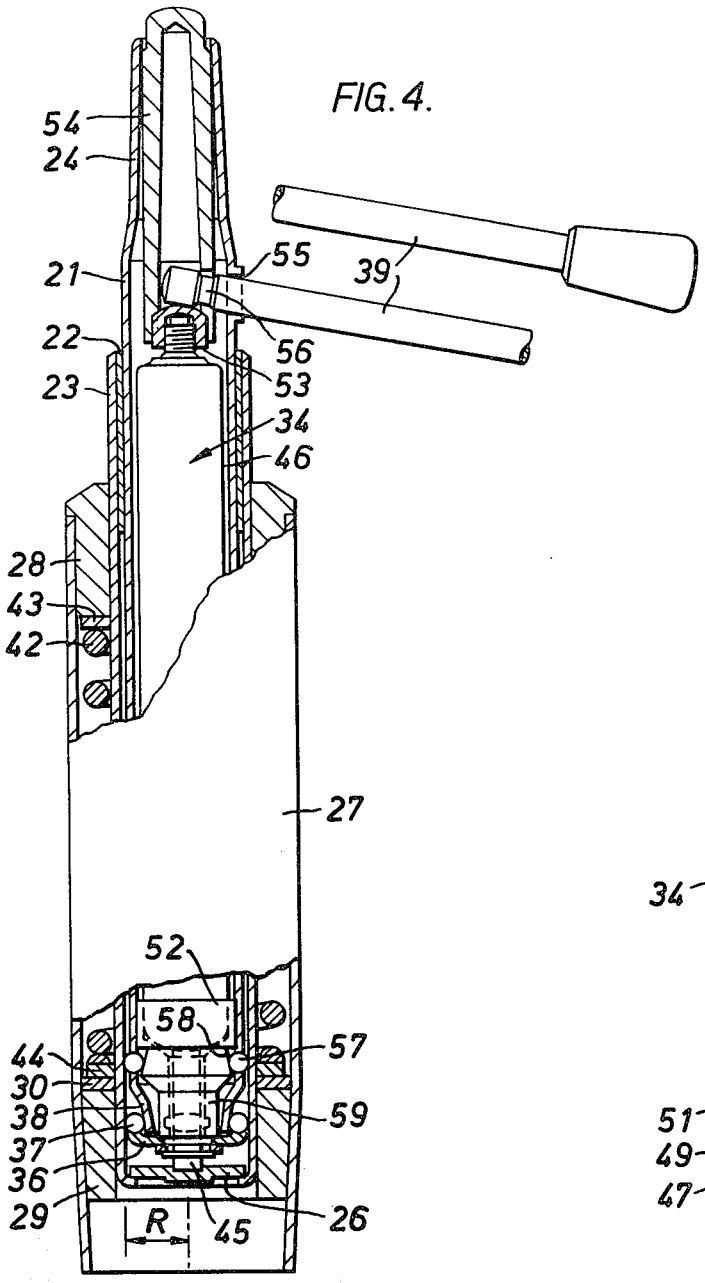
FIG. 4 shows a preferred advanced embodiment of a telescopic device according to the invention in axial section.

Whilst the design shown in FIG. 1 is inexpensive and is satisfactory for many applications, especially for example for simple office chairs, the design shown in FIG. 4 is far more advanced, especially with respect to increased comfort. In this figure, components having the same or a corresponding function as those in FIG. 1, have been designated with the same reference numerals increased by 20.

The telescopic tubes 21 and 23 with sliding bearings 22 are in all substantial respects identical to those in FIG. 1. Further, the outer tube 23 is here likewise rotatably mounted in a surrounding box 27, but is supported from the same via an intermediate shock-absorbing helical spring 42 acting between a washer 43 fixed to the tube 23 and in frictional engagement with the bottom side of the upper radial bearing 28, and the upper part 44 of an axial sliding bearing 30 on top of the lower radial bearing 29, so that in free condition of the telescopic device the spring 42 serves for preventing undesired rotation of the latter.

However, the main difference from the first embodiment resides in that the spring load on the supporting disc 36 for the rollers 37, which otherwise are shaped and arranged in the same manner as in the first embodiment, is in this case afforded by a so-called gas spring 34 which also serves for lifting, i.e. for elongating the telescopic device upon release of the locking system.

Figure 5:
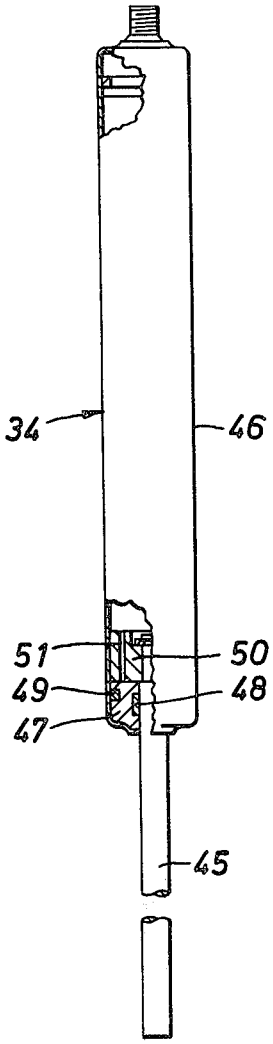
FIG. 5 shows in elevation and partly in axial section a so-called gas spring used as a combined locking and lifting spring in the embodiment shown in FIG. 4.

Although gas springs having these two functions in chair spindles are well known, for the sake of clearness such a spring has been shown in FIG. 5 and will briefly be described. It consists of a piston in the form of a rod 45 slidably and sealingly inserted in one end of a cylinder 46 through a sliding bearing 47 with outer and inner gaskets 48 and 49, respectively, and guided within the cylinder with a piston head 50 attached to it by screwing. For the rest the cylinder 46 is closed and filled with a gas, for example nitrogen, under high pressure. The piston head 50 is formed with one or more passages 51, so that the pressure will constantly be the same on both sides of it. Consequently, in any position of the piston in the cylinder, there will act a force between them in outward direction and equal to the pressure times the cross-sectional area of the piston rod. Since the force is inversely proportional to the gas volume, which varies with displacement of the piston in the cylinder by an amount only corresponding to the volume of the part of the piston rod 45 projecting into the cylinder, the force on the piston will be very nearly constant irrespective of its position in the cylinder. In the position shown in FIG. 4 the inner tube 21 practically adopts its lowermost position in the outer tube 23 and the rod 45 is very near to its innermost position in the cylinder 46. The supporting disc 36 is attached with a spring washer to the lower end of a sleeve-shaped extension 59 attached with a cap 52 to the lower end of the cylinder 46. Due to the piston being supported by the bottom 26, the cylinder 46 of the gas spring will therefore constantly tend to move upwards, and consequently the supporting disc 36 will press the rollers 37 up between the inner face of the outer tube 23 and the downwardly tapering faces 38 of the lower tube 21.

Releasing is effected by displacing the cylinder 46 and hence, through the extension 59, also the supporting disc 36 downwards relative to the inner tube. To this effect a pressure is exerted on a button 53 screwed onto an extension pin on the upper end of the cylinder 46. This may very well take place in the same manner as shown in FIG. 1 by pressing a lever similar to the lever 19 against the upper end of a hollow extension 54 placed on the button 53. Yet, in the case shown a different arrangement is used, which is suitable in cases where the fitting to be mounted on the device is not equipped in the manner described. In the case shown a lever 39 is supported for limited pivotal movement in an orifice 55 in the wall of the inner tube 21 and also extends through a cut-out in the wall of the hollow extension 54, where it is held in position with an annular groove 56. The extension 54 is in non-rotational engagement with the button 53 and can be pulled off from the same so that it will be possible in absence of the lever 39, that is at the stage of initial mounting or for later correction, to screw the button 53 up or down so as to perform a fine adjustment of the path of displacement of the supporting disc (36) relative to the inner tube 21 and thereby to obtain both a full clamping action and complete release exactly as intended.

In released position the cylinder 46 with the disc 36 can be displaced freely up or down, and by removing sufficient weight from the inner tube the gas spring 34 will thereby lengthen and via the support for the lever 39 entrain the inner tube upwards for lifting the seat. The force of the gas spring is conveniently adapted so that it will be overcome under the weight of an adult person sitting in the chair, but is more than sufficient for lifting the seat when not loaded, so that the displacement in released position will take place automatically up or down according to whether the load on the seat is removed or persists. A force of about 40–45 kilgrams is usually regarded as adequate.

As mentioned above the rollers 37 afford good safety against unintentional shortening of the telescopic device under load, since they are merely clamped harder the greater the load, and on the other hand unlocking may nevertheless be effected with a relatively moderate force, since only rolling friction has to be overcome. Yet, the latter fact may in certain situations involve a risk of an undesired effect, since in case the rollers have not been wedged forcibly and the chair is lifted, it might occur that the system is unlocked, so that the gas spring 34 entrains the supporting disc 36 and hence the rollers 37 upwards, and the telescopic device is thereby lengthened unintentionally.

To prevent this risk additional rollers 57 have been inserted with ample play in orifices in the inner tube 21 above the inclined faces 38 and are in locking position engaging the outer tube 23 and upwardly tapering faces 58 of the sleeve 59. In locking position when the gas spring 46 urges the sleeve 59 upwards, the rollers 57 can thereby enhance the locking action of the rollers 37, whereas they are liberated when a pressure is exerted on the gas spring with the lever 39. And when such a pressure does not exist, if the locking effect of the rollers 37 should fail, the locking action of the rollers 57 will persist and even be enhanced due to these rollers being pressed more firmly against the outer tube.

In this manner the telescopic device is safely locked against displacement both upwards and downwards, so long as the locking action is not released intentionally with the lever 39.

The rolling elements 57 and the faces 58 may conveniently be shaped in a manner corresponding to that of the rolling elements 37 and the faces 38. But since this locking system is never exposed to excessive load by heavy persons, the risk of permanent deformation of the outer tube is in this case less pronounced, so that it might be possible to use ball-shaped rolling elements at this location.

The embodiment shown in FIG. 4 distinguishes itself by particularly good permanent functional safety not only for the reasons mentioned but also because the gas spring in only working when adjustments are performed, and otherwise is firmly locked, so that the sliding seal between piston and cylinder is not subjected to constant wear. The desired resiliency of the chair in use is afforded by the spring 42, which in addition, due to the braking action of the washer 43, ensures that the seat does not rotate unintentionally when not loaded, whereas the braking action is removed as soon as the spring 42 is slightly compressed when the seat is loaded, so that the seat can be turned freely by a person sitting on the chair.

It will be understood that the invention may be carried out in many other ways than those described above with reference to the drawings. In addition to being capable of being used for other applications than for chair spindles, which may involve adaptation of the design to the applications concerned, the use of the invention is inter alia not restricted to structures where the telescoping tubes have circular cross-section, since also polygonal cross-sections may be contemplated, and it will also be possible to use the invention in connection with telescopic devices having more than two telescoping tubes.

What I claim is:

1. Adjustable telescopic device designed for substantially vertical mounting, in which an inner tube is slidably inserted in an outer tube and projects upwards from the same and is adapted to carry a load, for example from a chair seat, and to be locked at its lower end to the outer tube by frictional action of rolling elements, which by means of a spring loaded supporting element are pressed up between an inner face of the outer tube and downwardly tapering contacting faces of the inner tube so as to be wedged therebetween, wherein said inner face has a prescribed curved contour in cros-section taken transversely of said outer tube, and wherein said inner tube can be released by manual actuation of the supporting element against the spring load, said device being characterized in that the rolling elements comprise plural rollers, each having a circumferential face which is shaped with a generatrix corresponding to said prescribed curved contour of the inner face of the outer tube.

2. A telescopic device as claimed in claim 1, characterized in that the tapering contacting faces of the inner tube have a cross-sectional shape, taken transversely of the inner tube, which substantially corresponds to the generatrix of the rollers.

3. A telescopic device as claimed in claims 1 or 2, further comprising:

spring means constantly exerting an upward force on said supporting element to provide the spring load thereon while acting between said inner and outer tubes to lift the inner tube relative to the outer tube in response to lowering of the supporting element for releasing the rolling elements; and a member connected to the supporting element and have upwardly tapering faces; wherein between the inner wall of the outer tube and said upwardly tapering faces of said member there are located additional rolling elements which, in a locking position of the device, contribute in locking against upward pulling of the inner tube.

4. A telescopic device as claimed in claim 3, characterized in that the member is included in the operating system for the supporting element and is located within the inner tube, and in that the additional rolling elements are movably accommodated in orifices in the wall of the inner tube.

5. A telescopic device according to claims 1 or 2, further including:

manually-operated means having a limited range of motion for imparting relative displacement between said supporting element and said inner tube in a direction to release engagement therebetween; and mechanical connection means including an adjustable member for adjusting the path of said relative displacement.

* * * * *